United States Patent [19]

LaCount et al.

[11] Patent Number: 4,649,728

[45] Date of Patent: Mar. 17, 1987

[54] INTEGRAL JOINT FORMING OF WORK-HARDENABLE HIGH ALLOY TUBING

[75] Inventors: Dale F. LaCount, Alliance; Richard L. Holbrook, Louisville; Dean L. Mayer, Alliance, all of Ohio; Kurt J. Kahlow, deceased, late of Reston, Va., by Ronald A. Kahlow, executor

[73] Assignee: The Babcock & Wilcox Company, New Orleans, La.

[21] Appl. No.: 726,208

[22] Filed: Apr. 23, 1985

[51] Int. Cl.[4] ..... B21C 37/16

[52] U.S. Cl. ..... 72/85; 72/96; 72/370

[58] Field of Search ..... 72/81, 85, 367, 370, 72/68, 96, 100, 107, 109, 264, 265, 276, 77, 78; 29/DIG. 49

[56] References Cited

U.S. PATENT DOCUMENTS

| | | | |
|---|---|---|---|
| 1,412,196 | 4/1922 | Rabold | 72/370 |
| 2,003,710 | 6/1935 | Graham et al. | 29/DIG. 49 |
| 2,335,933 | 12/1943 | Goheen et al. | 72/370 |
| 2,494,128 | 1/1950 | Holmquist et al. | 72/367 |
| 3,465,563 | 9/1969 | Verdickt | 72/96 |
| 4,454,745 | 6/1984 | Cudini | 72/370 |

FOREIGN PATENT DOCUMENTS

| | | | |
|---|---|---|---|
| 73113 | 4/1984 | Japan | 72/276 |
| 680596 | 10/1952 | United Kingdom | 72/367 |

*Primary Examiner*—Lowell A. Larson

*Attorney, Agent, or Firm*—Vytas R. Matas; Robert J. Edwards

[57] ABSTRACT

A method of fabricating a tube having enlarged ends and made of material which can be strengthened by cold working comprises fabricating a pre-form having the overall configuration of the tube but with increased outside diameters and a decreased length. The pre-formed tube is cold forged or cold rolled over its entire length to reduce its outside diameter while maintaining its inside diameter substantially fixed. This elongates the tube and reduces its cross-sectional area. Cold working is continued until the final desired dimensions for the tube are reached. This produces a strengthening effect by cold working over the entire length of the tube.

9 Claims, 5 Drawing Figures

FIG. 3
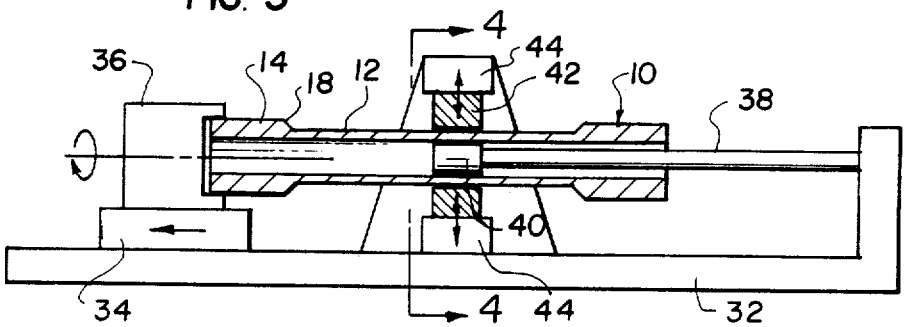
FIG. 4
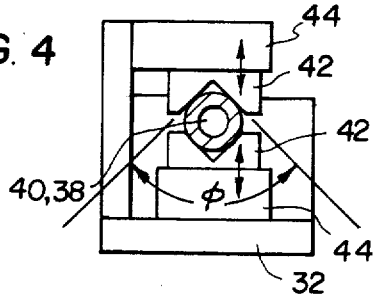
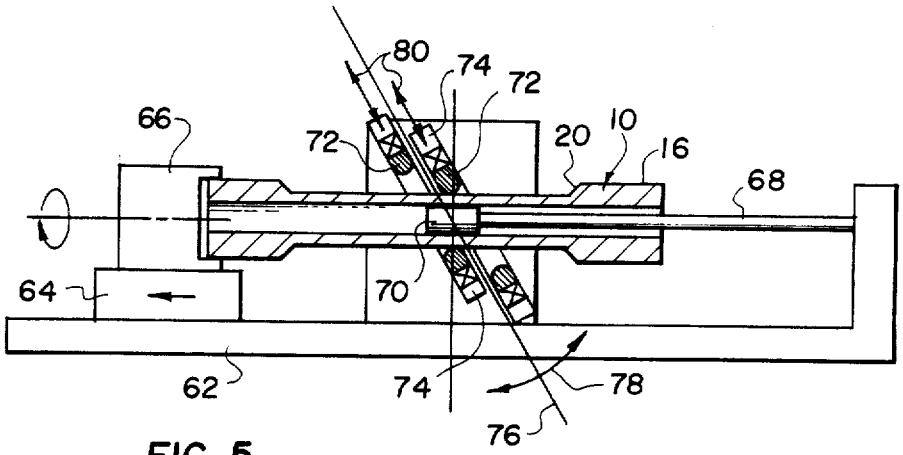
FIG. 5

INTEGRAL JOINT FORMING OF WORK-HARDENABLE HIGH ALLOY TUBING

FIELD AND BACKGROUND OF THE INVENTION

The present invention relates in general to tube and pipe manufacturing techniques, and in particular to a new and useful method of making a tube which has an integral joint formed by an enlarged end of the tube. A tube which initially has a uniform outside diameter, wall thickness and inside diameter, can be provided with one or two integral joint ends by heating the end or ends of the tube and hot upsetting that end to increase the outside diameter and the wall thickness, and to decrease the inside diameter, at the end of the tube. This upset and enlarged end can subsequently be machined to form male or female threads.

Before machining the upset ends of such a tube, it is known to heat treat the entire tube to obtain a desired strength level. It is also known to initially manufacture the tube along with its upset ends so that it has its nominal finished size.

This technique however is not applicable for tubes made of materials that develop strength by cold working. Such materials must be cold worked at least to a minimum extent to obtain a required strength. Uniform cold working is desired to obtain uniform properties. It has been considered impractical to use such materials to form tubes having upset ends because cold upsetting is an impractical technique for forming these ends. This is because the forces are too high to upset the ends with a small number of blows or hits and the number of hits is too high if lower forces are used. Even if these difficulties were overcome however it is not possible to control the amount and uniformity of cold working along the entire length of the tube. While the ends of such a tube might be strengthened by the cold upsetting action, the intermediate length of the tube would not be strengthened.

SUMMARY OF THE INVENTION

The present invention is drawn to a method of manufacturing integral joint tubes having at least one heavy end, out of material which is hardened by cold working.

According to the invention, a tube made of such material is utilized which initially has a body portion, tapered portions and upset or heavy end portions such that a cross-sectional area of the tube is larger, by a fixed percentage, than a final desired cross-sectional area for the tube. The outside diameter (OD) and wall thickness are larger than the final desired values while the inside diameter (ID) is slightly larger or almost the same as the final nominal value. The length of the tube initially is proportionately shorter than its final desired length.

The heavy ends of the tube may be formed by any known means including the hot upsetting of the ends of an initially uniform tube, the cold upsetting of the tube ends, or even the machining of an initially uniform tube shaped or bar shaped workpiece.

The pre-formed tube is then cold worked along its entire length to reduce its outside diameter and wall thickness and to size its inside diameter. This is done along the body portion, the tapers and the upset or heavy end portions of the tube. As the cross-sectional area of the tube is reduced, it becomes elongated until it obtains its desired finished length.

It has been found that the cross-sectional area of pre-formed tubes can successfully be reduced by 17 to 72% and using tubes having a variety of diameters, wall thicknesses and lengths, while still producing tubes having uniform strength.

While various known cold working techniques can be used for a uniform area reduction, two particular cold working techniques have been used successfully. Precision rotary forging has been used which utilizes a mandrel in the ID of the tube with hammers striking the OD of the tube as the tube is rotated and moved axially beneath the hammers. The inventive method has also been practiced using an external roll extrusion process wherein a mandrel is placed in the ID of the tube while a pair of unpowered rolls are held firmly against the OD of the tube while the tube is rotated and moved axially.

Accordingly it is an object of the present invention to provide a method for manufacturing a tube having at least one enlarged end, out of material which is strenthened by cold working, comprising fabricating a pre-formed tube of the material, which has a body portion and at least one enlarged end portion with initial outside diameter, wall thickness, inside diameter, length and cross-sectional area, and cold working the pre-formed tube over its body and end portions to reduce its outside diameter, wall thickness and cross-sectional area and increase its length to final desired values. The tube is thus strengthened along substantially its entire length and substantially uniformly.

A further object of the present invention is to manufacture the tube out of metal, and in particular alloy which is strengthened when subjected to cold working, such as Type 304 stainless steel or Incoloy 825 (a tradename of International Nickel Company, Inc.)

A further object of the present invention is to use precision rotary forging for the cold working of the tube.

A still further object of the invention is to use an external roll extrusion process for the cold working of the tube.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a schematic side elevational view of a precision rotary forging device which can be used for cold working the pre-formed tube;

FIG. 4 is a view taken along the line 4—4 of FIG. 3, showing the hammers of the rotary forge; and FIG. 5 is a schematic side elevational view of an external roll extrusion device used in accordance with the invention.

DESCRIPTION OF THE PREFERRED EMBODIMENTS

Figure 1:
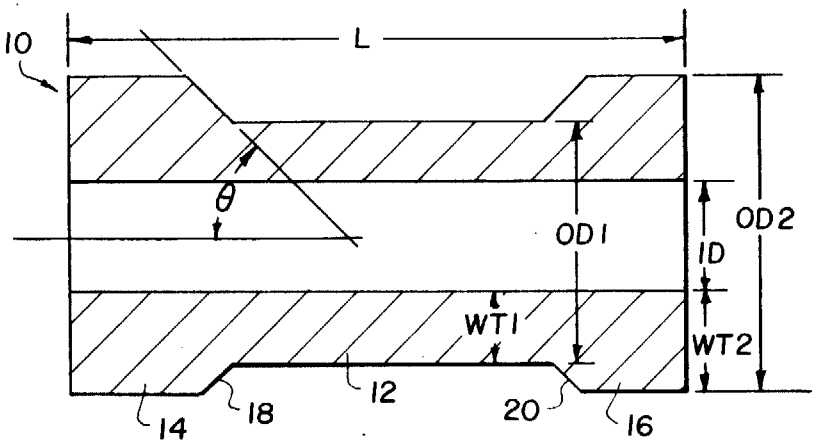
FIG. 1 is a side sectional view of a pre-formed tube made of material which is strengthened by cold working.

Referring to the drawings in particular, the invention illustrated therein is a method of manufacturing a tube having at least one, and preferably two enlarged ends, with the tube being made of material that is strengthened by cold working.

FIG. 1 shows a pre-formed tube generally designated 10 having a central body portion 12 and enlarged end portions 14 and 16. Each of the enlarged end portions can be formed by hot upsetting, cold upsetting, machining or any other known technique. The pre-formed tube 10 has an initial length L and an initial substantially uniform inside diameter ID which can be established by machining or during the fabrication of the pre-form 10.

The body portion 12 has an initial outside diameter OD 1 while the end portions have initial outside diameters OD 2. Similarly, the body and ends portions have initial wall thicknesses designated WT 1 and WT 2.

The end portions 14 and 16 are separated from the body portion 12 by tapered areas 18 and 20 which are tapered at an angle $\theta$ with respect to the axis of preform 10.

Figure 2:
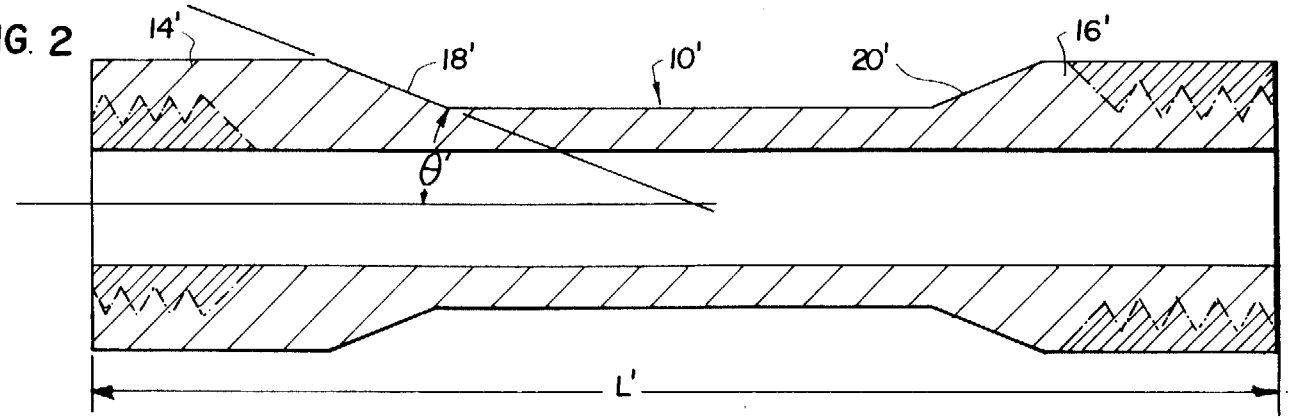
FIG. 2 is a view similar to FIG. 1 of the tube after it has been subjected to cold working over its length to reduce its cross-sectional area while increasing its length and correspondingly adjusting its other dimensions to final desired values.

FIG. 2 shows the configuration of the tube after it has been subjected to cold working over its entire length. The tube, designated 10' in FIG. 2, has been cold worked until it has final values for the outside diameters and wall thicknesses of its end portions 14',16' and its body portion 12'. The angle of tapered portions 18',20' is reduced and now designated $\theta'$.

By cold working the tube over its entire length, it assumes a final desired length L' as well.

Phantom lines at end 14' show how that end can be machined into a female joint by removing the cross-hatched area. The opposite enlarged end 16' can be made into male threaded joint which is also shown in phantom line and can be established by machining away the more densely cross-hatched area at this end of the tube.

Tubes according to the invention have been made using Type 304 stainless steel and Incoloy 825.

In one of many samples which were actually manufactured, an initial end area outside diameter (OD2) of about 4.3 inches and an initial outside body diameter (OD1) of about 3.3 inches was utilized. The uniform initial inside diameter was 2.350 inches and the transition taper $\theta$ was 10°. After cold forging, OD1 was equal to about 2.9 inches, OD2 was equal to about 3.6, the ID was equal to about 2.3 inches and crosssectional area was reduced 45%. The tapered area was reduced to angle $\theta'$ of 3.4°.

Pre-forms having similar initial dimensions were also cold forged to reduce their area by 30,40,50,60 and 70%.

Various tube lengths were also successfully manufactured.

FIG. 3 shows a cold precision rotary forging machine generally designated 30 which was used to practice the invention. It includes fixed frame 32 that slidably carries carriages 34 and 35 which can move on frame 32 by at least the full length of a tube 10 to be manufactured. Carriages 34 & 35 carry rotary tool clamping heads 36 and 37 which are capable of firmly grasping the enlarged end portions 14 and 16 of tube 10, and rotating the ends at a selected rate. Drive means are provided for this purpose. Drive means are also provided for moving carriages 34 and 36 on support 32. Support 32 carries a mandrel bar 38 which extends axially into the ID of tube 10 and terminates at a mandrel 40. Hammers 42 are provided and are mounted on hammer drives 44 to the support 32 for reciprocally hammering the OD of tube 10. The shape of the hammers can be changed for cold forging the tapered transition areas 18 and 20, and for hammering the enlarged end portions 14 and 16. The point of cold forging is continuously changed by rotation of head 36 and movement of carriage 34.

As shown in FIG. 4, it has been found advantageous to provide hammers 42 with faces that form a V and lie at an angle which is closer to 90° than known hammers. The use of such hammers has been found to avoid a binding effect between the ID of the tube 10 and the mandrel 40. It has also been found helpful to lubricate the ID of the tube and the outer surface of the mandrel, and to actively cool the mandrel using water for example.

One combination of lubricants which was found particularly useful was the use of STP oil (a tradename of STP Corporation) on the ID of the tube and nickel NEVER-SEEZ (a tradename of NEVER-SEEZ COMPOUND CORPORATION) on the surface of the mandrel.

Mandrels made of high speed tool steel, solid tungsten carbide, sintered high speed tool steel, and titanium nitride-coated high speed tool steel were found to be useful in practicing the invention.

Turning to FIG. 5, an external roll extrusion device generally designated 60 is shown which is also provided with a fixed support 62, a movable carriage 64 and a rotary tube holding head 66. A mandrel bar 68 extends axially into the ID of the tube 10 and terminates at a mandrel head 70. Rather than using hammers however as in the rotary forger of FIG. 3, a pair of extrusion rolls 72 are utilized. These rolls are in the form of rings and are mounted for rotation by bearings on roll mounts 74. Roll mounts 74 are supported on fixed support 62 and their plane shown at 76 can be pivoted in the direction of double arrow 78 so that a peripheral portion of the interior of one ring or roll 72 contacts a top surface of tube 10 while a peripheral portion of the other ring 72 contacts an opposite side of tube 1 at a radially aligned location on the tube. The contact points are positioned on opposite sides of the mandrel 70. To accommodate the tapered and enlarged areas of the tube 10, the bearings 74 can be moved in the direction of double arrows 80 and also the plane 76 can be tilted to always maintain proper relationship between the contact points and the mandrel 70.

While specific embodiments of the invention have been shown and described in detail to illustrate the application of the principles of the invention, it will be understood that the invention may be embodied otherwise without departing from such principles.

What is claimed is:

1. A method for manufacturing a tube of constant inside diameter having at least one enlarged end and made of a material which is strengthened by cold working, comprising:

fabricating a pre-formed tube of the material which has a body portion, at least one enlarged end portion and a transition taper between the at least one enlarged end and the body portion with initial outside diameter, wall thickness, inside diameter, length and cross-sectional area;

inserting a mandrel into the inside diameter of the tube; and cold working the outside diameter of the pre-formed tube near said mandrel over its body and end portions to uniformly reduce its cross-sectional area and to increase its length to final desired values whereby the cold worked tube is strengthened along its body and end portions.

2. A method according to claim 1, including cold working the pre-formed tube using a rotary forging device having at least one rotatable and translatable head for holding at least one end of the pre-formed tube, a mandrel for positioning in the inside diameter of the tube and at least one hammer for striking the outside diameter of the tube.

3. A method according to claim 1, including cold working the pre-formed tube using an external roll extrusion device having a rotatable and translatable head for holding one end of the tube, a mandrel for insertion into the inside diameter of the tube, and at least one extrusion roll for contacting the outside diameter of the tube.

4. A method according to claim 1, including lubricating at least one of the mandrel and the inside diameter of the tube during the cold working of the pre-formed tube.

5. A method according to claim 4, including lubricating both the mandrel and the inside diameter of the tube during the cold working.

6. A method according to claim 1, including fabricating the pre-formed tube by upsetting the end of an initially uniform tube to form the at least one enlarged end.

7. A method according to claim 6, including hot upsetting the end of the initially uniform tube.

8. A method according to claim 6, including cold upsetting the end of the initially uniform tube.

9. A method according to claim 1, including fabricating the pre-formed tube by machining an initially uniform tube to form the body portion and at least one end portion of the pre-formed tube.

* * * * *

UNITED STATES PATENT AND TRADEMARK OFFICE

CERTIFICATE OF CORRECTION

PATENT NO. : 4,649,728

DATED : March 17, 1987

INVENTOR(S) : Dale F. LaCount et al.

It is certified that error appears in the above-identified patent and that said Letters Patent is hereby corrected as shown below:

FIGS. 3 and 4 should appear as shown on the attached sheets.

Signed and Sealed this

Fifth Day of July, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,649,728

DATED : March 17, 1987

INVENTOR(S) : LaCount, et al

It is certified that error appears in the above-identified patent and that said Letters Patent are hereby corrected as shown below:

Fig. 3 should be as shown below, to indicate that the rotary forging process uses a carriage 35 and a rotary tool clamping head 37 on the right hand end of the tube 10.

FIG. 3

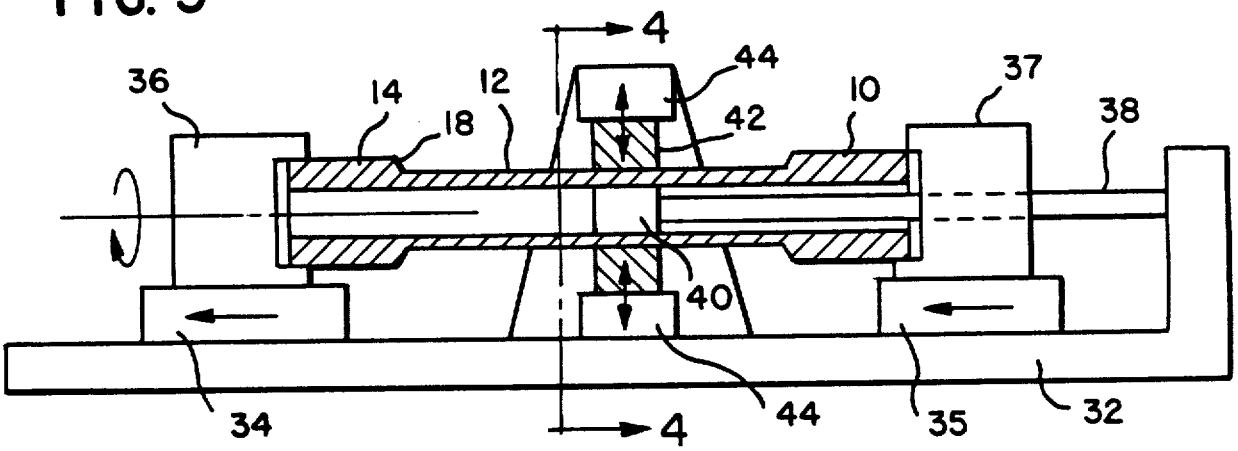

UNITED STATES PATENT AND TRADEMARK OFFICE

CERTIFICATE OF CORRECTION

PATENT NO. : 4,649,728

DATED : March 17, 1987

INVENTOR(S) : LaCount, et al

It is certified that error appears in the above-identified patent and that said Letters Patent are hereby corrected as shown below:

Fig. 4 should be as shown below, to indicate that the rotary forging process uses <u>four</u> hammers 42.

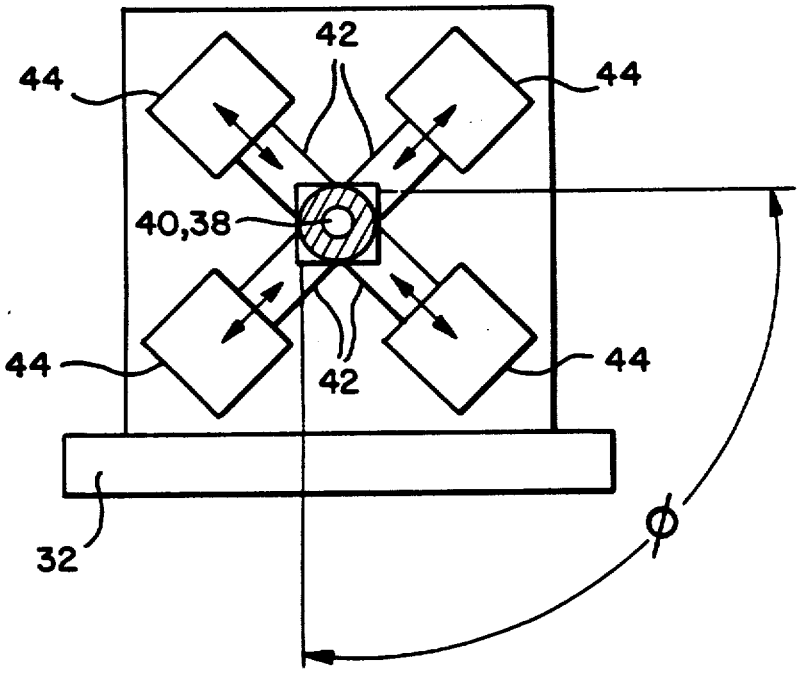

FIG. 4